US005979318A

United States Patent [19]

Helmstädter

[11] Patent Number: 5,979,318

[45] Date of Patent: Nov. 9, 1999

[54] METHOD AND APPARATUS FOR SMEAR-FREE GUIDANCE OF A PRINTED SHEET ON A SHEET-GUIDING CYLINDER OF A PRINTING PRESS

[75] Inventor: Karl-Heinz Helmstädter, Sinsheim, Germany

[73] Assignee: Heidelberger Druckmaschinen AG, Heidelberg, Germany

[21] Appl. No.: 09/050,658

[22] Filed: Mar. 30, 1998

[30] Foreign Application Priority Data

Mar. 29, 1997 [DE] Germany ..... 197 13 361

[51] Int. Cl.[6] ..... B41F 13/24

[52] U.S. Cl. ..... 101/232; 101/419; 101/420; 271/268; 271/277

[58] Field of Search ..... 101/416.1, 419, 101/420, 229, 230, 232, 240; 271/82, 85, 204, 205, 268, 277, 195, 269

[56] References Cited

U.S. PATENT DOCUMENTS

| | | | |
|---|---|---|---|
| 4,395,949 | 8/1983 | Jeschke | 101/420 |
| 4,815,379 | 3/1989 | Becker et al. | 101/246 |
| 5,029,524 | 7/1991 | Wirz et al. | 101/232 |
| 5,421,257 | 6/1995 | Okuda et al. | 101/137 |
| 5,787,810 | 8/1998 | Stephan | 101/232 |

*Primary Examiner*—Edgar Burr
*Assistant Examiner*—Dave A. Ghatt
*Attorney, Agent, or Firm*—Herbert L. Lerner; Laurence A. Greenberg

[57] ABSTRACT

A method for smear-free guidance of a printed sheet on a given sheet-guiding cylinder of a printing press includes taking over a leading edge of the sheet by a gripper device of the given sheet-guiding cylinder from a preceding or up-line sheet-guiding cylinder and, after the take-over of the leading edge of the sheet by the gripper device, fixing a first section of the underside of the sheet to the circumferential surface of the preceding or up-line sheet-guiding cylinder in a manner that the sheet, which has been pushed onwardly by the preceding or up-line sheet-guiding cylinder, is kept spaced from the circumferential surface of the given sheet-guiding cylinder, and the circumferential surface of the given sheet-guiding cylinder is located, as viewed in radial direction, within a circular path described by the gripper device during the rotation of the given cylinder.

23 Claims, 4 Drawing Sheets

METHOD AND APPARATUS FOR SMEAR-FREE GUIDANCE OF A PRINTED SHEET ON A SHEET-GUIDING CYLINDER OF A PRINTING PRESS

BACKGROUND OF THE INVENTION

Field of the Invention

The invention relates to a method and an apparatus for smear-free guidance of a printed sheet on a sheet-guiding cylinder of a printing press, in particular, on a turning drum of a sheet-fed rotary offset printing press in first-form or recto sheet printing mode, wherein a leading edge of a sheet is taken over by a gripper device of the sheet-guiding cylinder from a sheet-guiding cylinder preceding or located up-line from the latter.

In the field of sheet-fed rotary offset printing presses, there is a problem that, when sheets are transported through the printing press, the freshly printed side thereof come into contact with the circumferential surfaces of the transfer cylinders transporting them, thereby smearing the printed image in contact with the circumferential surface. To avert smearing of the freshly printed image, various methods have become known heretofore in the prior art for guiding a printed sheet in a smear-free manner on the circumferential surface of a printing press cylinder.

It has become known heretofore, for example, from European Patent 0 059 944 to slip over a sheet-guiding cylinder an ink-repelling net which is easily movable on the surface of the cylinder, in order to prevent smearing of a freshly printed page of the sheets.

It has also become known heretofore from the Published, Non-prosecuted German Patent Application (DE-OS) 195 46 311 A1 to equip a sheet transfer drum with inflatable jacket segments formed with openings in the surface thereof out of which air flows so as to produce a supporting air film for holding the sheet on the transfer drum.

The problem of smearing a freshly printed upper side of a sheet on the circumferential surface of turning drums of sheet-fed rotary printing presses having a turning device occurs in a similar manner, if these presses are operated at a high printing speed in a first-form or recto sheet printing mode.

Such a printing press with a sheet-turning device having a turning drum has become known heretofore, for example, from German Patent DE 30 50 295, wherein a sheet, in a first-form or recto sheet printing mode, is taken over by a tongs-type gripper of the turning drum from a preceding or up-line storage drum and, thus, a freshly printed upper side of the sheet comes into contact with the circumferential surface of the turning drum. It has also become known from this German patent to fix the sheet at the trailing edge thereof by suction cups to the circumferential surface of the storage drum.

SUMMARY OF THE INVENTION

It is accordingly an object of the invention, to provide a method and an apparatus for smear-free guidance of a printed sheet on a sheet-guiding cylinder of a printing press and, in particular, on a turning drum of a sheet-fed rotary offset printing press in a recto sheet printing mode, which can be produced and operated economically and which highly reliably prevents smearing of the printed upper side of a sheet on the circumferential surface of a respective sheet-guiding cylinder. It is a further object of the invention to provide such a method and an apparatus which will simultaneously afford a desirable sheet guidance, wherein the sheet has the greatest possible radii of curvature while it is being transported.

With the foregoing and other objects in view, there is provided, in accordance with a first aspect of the invention, a method for smear-free guidance of a printed sheet on a given sheet-guiding cylinder of a printing press, which includes taking over a leading edge of the sheet by a gripper device of the given sheet-guiding cylinder from a preceding or up-line sheet-guiding cylinder, which comprises, after the take-over of the leading edge of the sheet by the gripper device, fixing a first section of the underside of the sheet to the circumferential surface of the preceding or up-line sheet-guiding cylinder in a manner that the sheet, which has been pushed onwardly by the preceding or up-line sheet-guiding cylinder, is kept spaced from the circumferential surface of the given sheet-guiding cylinder, and the circumferential surface of the given sheet-guiding cylinder is located, as viewed in radial direction, within a circular path described by the gripper device during the rotation of the given cylinder.

In accordance with another mode, the method of the invention, depending upon the material of the sheet to be printed on, the first section being fixed to the circumferential surface of a first sheet-guiding cylinder, is disposed in a rear or trailing region of the sheet in the case of lightweight papers, and in a region located between the leading edge of the sheet and the middle of the sheet in the case of heavy-weight papers.

In accordance with a further mode, the method of the invention includes causing a second section of the sheet extending from the first section to the end of the sheet to dip into a recess formed in the first sheet-guiding cylinder, after the first section of the sheet has moved past a central gripper station between the sheet-guiding cylinder and the preceding sheet-guiding cylinder.

In accordance with an added mode, the method of the invention includes undoing the fixation of the sheet before the first section of the sheet at which the sheet is fixed to the circumferential surface of the preceding sheet-guiding cylinder has moved past a central gripper station between the given sheet-guiding cylinder and the cylinder preceding it.

In accordance with an additional mode, the method of the invention includes applying suction to the first section of the underside of the sheet so as to suck the sheet against the circumferential surface of the preceding sheet-guiding cylinder and thereby fix the first section of the underside of the sheet to the circumferential surface.

In accordance with yet another mode, the given sheet-guiding cylinder has a cross-sectional form deviating from the circular, and the method of the invention includes pivoting the gripper device of the given sheet-guiding cylinder, during the rotation of the given sheet-guiding cylinder, so that a radius of curvature of the sheet while it is being transported around the given sheet-guiding cylinder assumes a maximally high value.

In accordance with yet a further mode, the given sheet-guiding cylinder is formed as a turning drum, and the preceding sheet-guiding cylinder is formed as a storage drum of a turning device of a sheet-fed rotary offset printing press operating in a recto sheet printing mode, and the method of the invention comprises adjusting the storage drum to a predetermined sheet size, depending upon the material of the sheet to be printed on.

In accordance with yet an added mode, the method of the invention comprises blowing air into the region between the given sheet-guiding cylinder and the preceding sheet-guiding cylinder onto the printed side of the sheet, and/or the region between the given sheet-guiding cylinder and the succeeding sheet-guiding cylinder, counter to the sheet transport direction, for assisting in the guidance of the sheet.

In accordance with a second aspect of the invention, there is provided an apparatus for smear-free guidance of a printed sheet on a given sheet-guiding cylinder of a printing press, wherein a leading edge of the sheet is taken over by a gripper device of the given sheet-guiding cylinder from a preceding sheet-guiding cylinder, comprising a circumferential surface being formed on the given sheet-guiding cylinder and being disposed, as viewed in radial direction, within a circular arc swept by the gripper device of the given sheet-guiding cylinder; and including a device for fixing a first section of an underside of the sheet to a circumferential surface of the preceding sheet-guiding cylinder so that the sheet, after being taken over by the gripper device, pushed onward by the preceding sheet-guiding cylinder, is kept spaced apart from the circumferential surface of the given sheet-guiding cylinder.

In accordance with another feature of the invention, depending upon the material to be printed on, the first section at which the sheet is fixed to the circumferential surface of the given sheet-guiding cylinder is disposed in a trailing region of the sheet, in the case of lightweight papers, and in a region between the leading edge of the sheet and the middle of the sheet, in the case of heavyweight papers.

In accordance with a further feature of the invention, the preceding sheet-guiding cylinder is formed with a recess into which there dips a second section of the sheet extending from the first section to the end of the sheet, after the first section of the sheet has moved past a central gripper station located between the given sheet-guiding cylinder and the preceding sheet-guiding cylinder.

In accordance with an added feature of the invention, the device for fixing the sheet is actuatable for releasing the sheet before the first section of the sheet has moved past a central gripper station located between the given sheet-guiding cylinder and the preceding sheet-guiding cylinder.

In accordance with an additional feature of the invention, the device for fixing the sheet is formed as a suction device.

In accordance with yet another feature of the invention, the suction device is a trailing-edge suction device of a storage drum of a turning device.

In accordance with yet a further feature of the invention, the given sheet-guiding cylinder has a cross-sectional shape deviating from the circular, and there is included a device for pivoting the gripper device of the given sheet-guiding cylinder, during the rotation of the given cylinder, in a manner that the radius of curvature imparted to the sheet during transport thereof around the given sheet-guiding cylinder, assumes a maximally high value.

In accordance with yet an added feature of the invention, the given sheet-guiding cylinder has a cross-sectional shape of a compressed octagon flattened at the sides.

In accordance with yet an additional feature of the invention, the given sheet-guiding cylinder is formed as a turning drum, and the preceding sheet-guiding cylinder is formed as a storage drum of a turning device of a sheet-fed rotary offset printing press operating in a recto sheet printing mode, the storage drum being adjusted to a predetermined sheet size, depending upon the material of the sheet to be printed on.

In accordance with still another feature of the invention, the apparatus according to the invention includes a first blower device for subjecting the region between the given sheet-guiding cylinder and the preceding sheet-guiding cylinder to blast air directed towards the printed upper side of the sheet.

In accordance with still a further feature of the invention, the apparatus according to the invention includes a second blower device for subjecting the region between the given sheet-guiding cylinder and a succeeding sheet-guiding cylinder to blast air counter to sheet transport direction.

In accordance with a third aspect of the invention, there is provided a method for smear-free guidance of a printed sheet on a sheet-guiding cylinder of a printing press, wherein a leading edge of the sheet is taken over by a gripper device of a given sheet-guiding cylinder from a preceding sheet-guiding cylinder, the circumferential surface of the given sheet-guiding cylinder, as viewed in radial direction, being located within a circular path described by the gripper device during the rotation of the cylinder; and which comprises pivoting the gripper device of the given sheet-guiding cylinder, during the rotation of the given cylinder, in a manner that a radius of curvature assumed by the sheet during transport thereof about the given sheet-guiding cylinder has a maximally high value, and guiding the printed side of the sheet at a spaced distance from the circumferential surface of the given sheet-guiding cylinder.

In accordance with another mode of the method according to the invention, the given sheet-guiding cylinder is formed as a turning drum, and the preceding sheet-guiding cylinder is formed as a storage drum of a turning device of a sheet-fed rotary offset printing press operating in a recto sheet printing mode, and the method includes adjusting the storage drum to a predetermined sheet size, depending upon the material to be printed on.

In accordance with a further mode, the method according to the invention includes blowing air into the region between the given sheet-guiding cylinder and the preceding sheet-guiding cylinder and onto the printed side of the sheet, and/or the region between the given sheet-guiding cylinder and a succeeding sheet-guiding cylinder, counter to the sheet transport direction, for assisting in the guidance of the sheet.

In accordance with a concomitant feature of the invention, the given sheet-guiding cylinder is a turning drum of a sheet-fed rotary offset printing press in a recto sheet printing mode.

The method and the apparatus according to the invention have the advantage in particular that they can be realized with only slight modifications in conventional turning devices of sheet-fed rotary offset printing presses, wherein the sheet in perfector or recto/verso printing is held by the trailing edge thereof by a suction device. Another advantage of the method and apparatus of the invention is that they assure reliably smear-free guidance of the printed sheets even if the sheets differ greatly over a wide range with respect to the material properties thereof and, in particular, the specific weight thereof.

Other features which are considered as characteristic for the invention are set forth in the appended claims.

Although the invention is illustrated and described herein as embodied in a method and apparatus for smear-free guidance of a printed sheet on a sheet-guiding cylinder of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
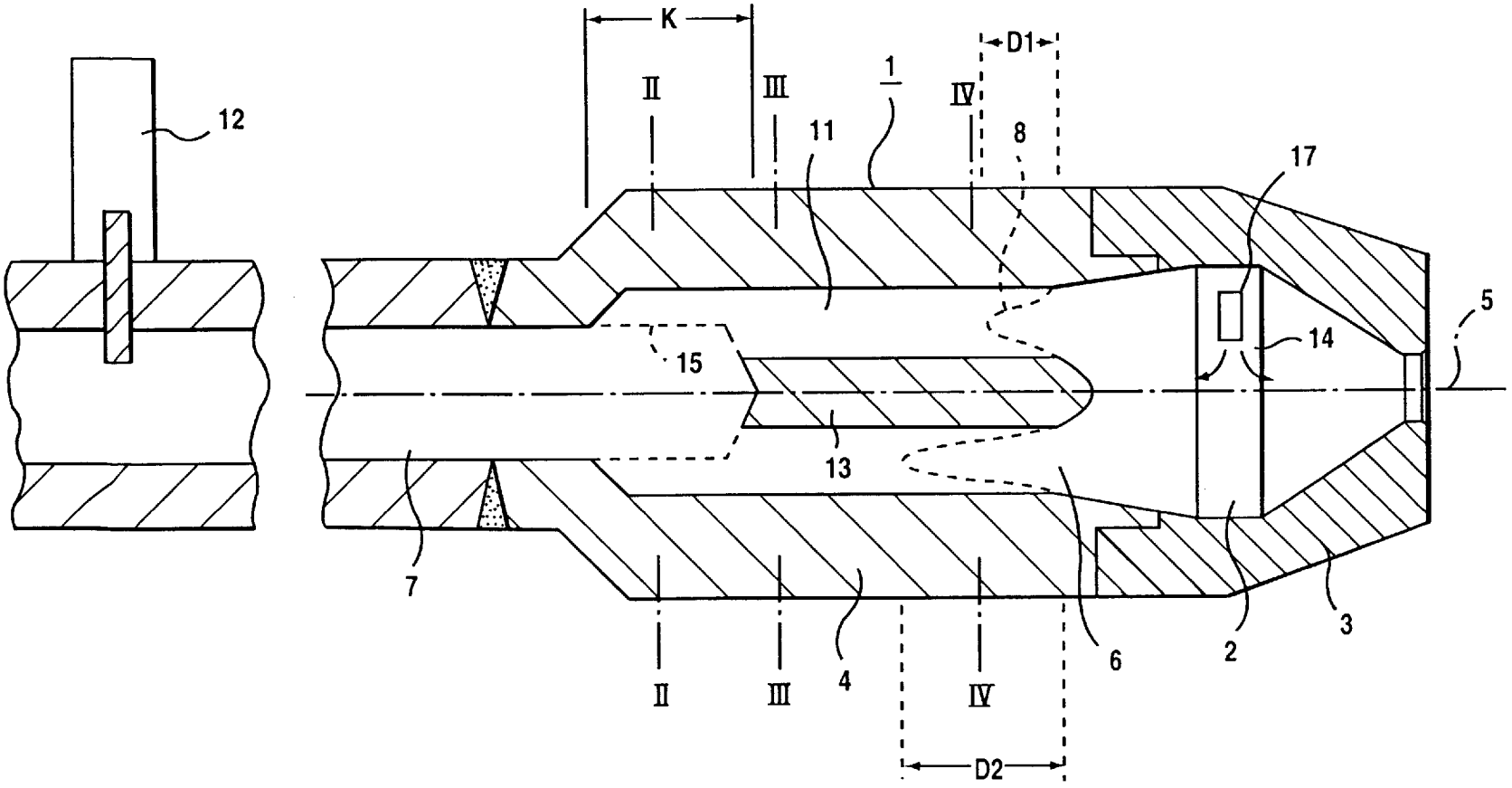
FIG. 1 is a fragmentary diagrammatic side elevational view, partly in section, of an apparatus for smear-free guidance of a printed sheet on a sheet-guiding cylinder of a printing press, according to the invention, wherein the sheet-guiding cylinder is formed by a turning drum, and a preceding or up-line sheet-guiding cylinder is formed by a storage drum of a turning device of a conventional sheet-fed rotary offset printing press, and wherein the turning drum has a substantially circular cross section.

Referring now to the drawings and, first, particularly to FIG. 1 thereof, there is shown therein an embodiment of the apparatus 1 for guiding a printed sheet 2, which includes a first sheet-guiding cylinder 4, on which a gripper device 6 is disposed so that it accepts or takes over the sheet 2 by a leading edge 8 thereof and transfers it to a succeeding or down-line sheet-guiding cylinder 10. The apparatus 1 according to the invention also includes a preceding or up-line sheet-guiding cylinder 12, which has one or more gripper devices 14 for transferring the sheet 2 by the leading edge 8 thereof to the gripper device 6 of the sheet-guiding cylinder 4. On the preceding or up-line sheet-guiding cylinder 12, a device 16 is also provided for fixing the sheet 2, at a first section 18 thereof, to the circumferential surface 20 of the preceding or up-line sheet-guiding cylinder 12. In a preferred embodiment of the invention, the device 16 is formed as a conventional suction device having several suckers which cause the underside 22 of the sheet 2 to be sucked against the circumferential surface 20 and thereby prevent relative motion of the sheet 2 with regard to the circumferential surface 20 of the preceding or up-line sheet-guiding cylinder 12 in the region of the first section 18.

Figure 2:
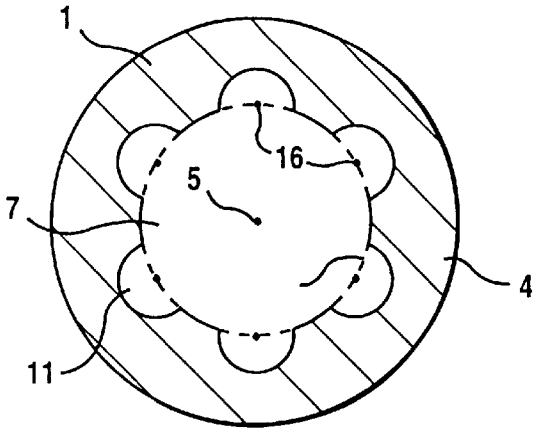
FIG. 2 is a view of the apparatus of the invention like that of FIG. 1, however, in an operating phase thereof wherein a leading edge of the sheet is transferred by a gripper device of the turning drum to a succeeding or down-line cylinder, and an end of the sheet dips into a recess formed in the storage drum.
Figure 3:
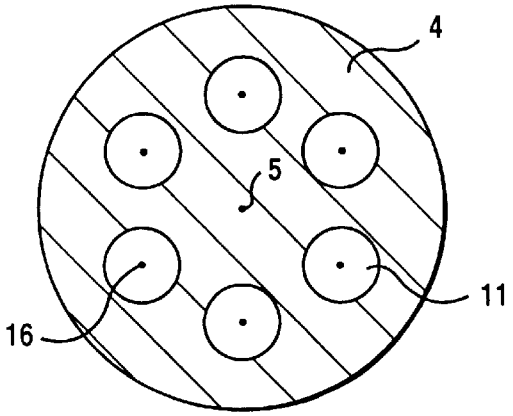
FIG. 3 is another view like those of FIGS. 1 and 2 showing the apparatus of the invention in a further operating phase thereof wherein the sheet has been transferred to a gripper device of the succeeding or down-line cylinder, and the end of the sheet moves along a limiting or defining surface of the recess formed in the storage drum.

In the preferred embodiment of the invention, the sheet-guiding cylinder 4 is formed by the turning drum, and the preceding or up-line sheet-guiding cylinder 12 is formed by the storage drum of a conventional turning device of a sheet-fed rotary offset printing press, which is operated in first-form or recto sheet printing mode wherein, in the embodiment of the invention shown in FIG. 1, only the upper side 24 of the sheet 2 has been printed on. As is shown in FIGS. 1 to 3, the turning drum or, in other words, the sheet-guiding cylinder 4, has a substantially circular cross section and, as viewed in the radial direction, the circumferential surface 26 of the cylinder 4 extends within a circular arc swept by the gripper device 6.

Mode of Operation

The mode of operation of the method and apparatus according to the invention is described hereinafter, taking as an example the turning device shown in the figures of the drawings. However, the method and apparatus of the invention are not limited to use in such a turning device but instead can be utilized in the same manner in any other sheet-guiding cylinder of a sheet-fed rotary printing press.

The sheet 2, which rests on and engages the circumferential surface 20 of the storage drum 12 by the non-printed underside 22 thereof and which is held at the leading edge 8 thereof by the gripper device 14 of the storage drum in the first-form or recto sheet printing mode, is sucked, at the underside of the first section 18 thereof, against the circumferential surface 20 of the storage drum 12, by the device 16, which in this case is preferably formed by the trailing-edge suction device 16 of the storage drum 12, before the leading edge 8 of the sheet is transferred to the gripper device 6 of the turning drum 4, and is fixed in such a manner on the circumferential surface 20 that motion of the first section 18 of the sheet relative to the circumferential surface 20 is prevented. After the leading edge 8 of the sheet is transferred to the gripper device 6 of the turning drum 4 or, in other words, once the gripper devices 6 and 14 have moved past the central gripper station 28 of the storage drum 12 and the turning drum 4, the sheet 2, which is fixed to the circumferential surface 20 of the storage drum 12 by the device 16, is pushed onward by the storage drum 12 when the latter drum rotates. Because the sheet 2 is held at the leading edge 8 thereof by the gripper device 6 and simultaneously pushed onward by the storage drum 12, the printed upper side 24 of the sheet is guided at a spaced distance from the circumferential surface 26 of the inversion drum 4.

In the preferred embodiment of the invention, the preceding or up-line sheet-guiding cylinder, i.e., the storage drum 12, is formed with a recess or gap 30 which, in the case of a storage drum, can be formed, for example, by adjusting the storage drum 12 in the first-form or recto sheet printing mode to a predetermined sheet size which, for example, may be the smallest sheet size that is to be printed. In this embodiment of the invention, depending upon the material to be printed, the first section 18 of the sheet 2, wherein the sheet 2 is fixed to the circumferential surface 20 of the storage drum 12, is preferably disposed in the rear or trailing region of the sheet 2, in the case of lightweight papers, and between the leading edge 8 of the sheet 2 and the middle of the sheet 2 in the case of heavyweight papers or cardboard. As shown in FIG. 2, the fixation of the first section 18 of the sheet is advantageously undone before the gripper device 6 of the transfer drum 4 has transferred the leading edge 8 of the sheet to a gripper device 34 of the succeeding or down-line sheet-guiding cylinder 10. By undoing or releasing the fixation of the sheet 2 at the first section 18 thereof, which can be effected, for example, by turning off the trailing-edge suction devices of the storage drum 12, the sheet 2 is no longer pushed onward by the storage drum 12, and a second section 32 of the sheet 2 extending from the first section 18 towards the end of the sheet 2 can dip into the recess or gap 30. However, the undoing or release of the fixation of the sheet 2 may also be performed at a later time, during or after the transfer of the leading edge of the sheet 2.

As shown in FIG. 3, the unprinted underside 22 of the sheet 2, in the region of the second section 32 thereof extending into the recess or gap 30, is preferably guided along a wall surface 36 defining the recess or gap 30, when the storage drum 12 rotates onwardly after the section 32 has dipped into the recess or gap 30, and the sheet 2 is guided at the leading edge 8 thereof by the gripper device 6 or 34, respectively. It is thereby possible for the sheet 2 to be guided without smearing even in the region of the central gripper stations 39 between the turning drum 4 and the succeeding or down-line sheet-guiding cylinder 10, without the printed upper side 24 of the sheet 2 coming into contact with the circumferential surface 26 of the turning drum 4.

It may also be advantageous that a blower device 38 be disposed between the transfer drum 4 and the succeeding or down-line sheet-guiding cylinder 10, and subject the region formed between the transfer drum 4 and the succeeding or down-line sheet-guiding cylinder 10 with blown or blast air counter to the sheet travel direction. It is equally possible for the region between the storage drum 12 and the turning drum 4 to be acted upon by blown or blast air through the intermediary of a second blower device 40, the blast or blown-air flows of which are directed substantially in the direction of the central gripper station 28, as well as toward the printed surface 24 of the sheet 2 which is to be kept smear-free. The quantity of blown or blast air and the direction of the blast or blown-air flows of the blower devices 38 and 40, respectively, can be adapted to suit the material to be printed and processed and the machine speed.

In the embodiments of the invention described hereinabove and shown in FIGS. 1 to 3, the sheet-guiding cylinder 4 has a substantially circular cross-sectional area, and the circumferential surface 26 of the cylinder 4 is located, as viewed in radial direction, within the circular arc swept by the gripper device 6 during a rotation of the cylinder. In this embodiment of the invention, after the gripper device 6 has gripped the leading edge 8 of the sheet, it preferably rotates along with the sheet-guiding cylinder 4, but without any pivoting overall of the gripper device 6 relative to the circumferential surface 26 of the cylinder 4.

Figure 4:
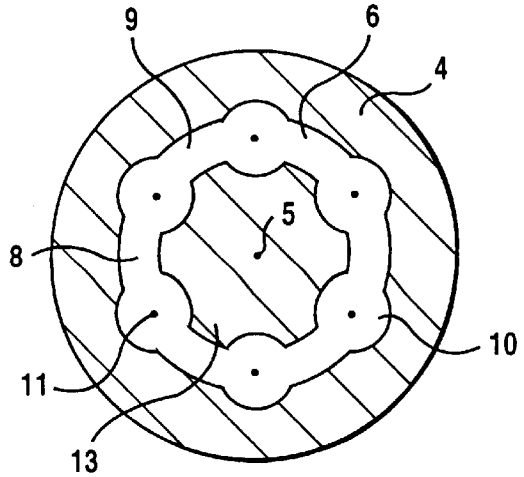
FIG. 4 is a view similar to those of the preceding figures showing another embodiment of the apparatus according to the invention in a first operating phase thereof, wherein the sheet-guiding cylinder is formed by a turning drum having a substantially octagonal cross section.
Figure 5:
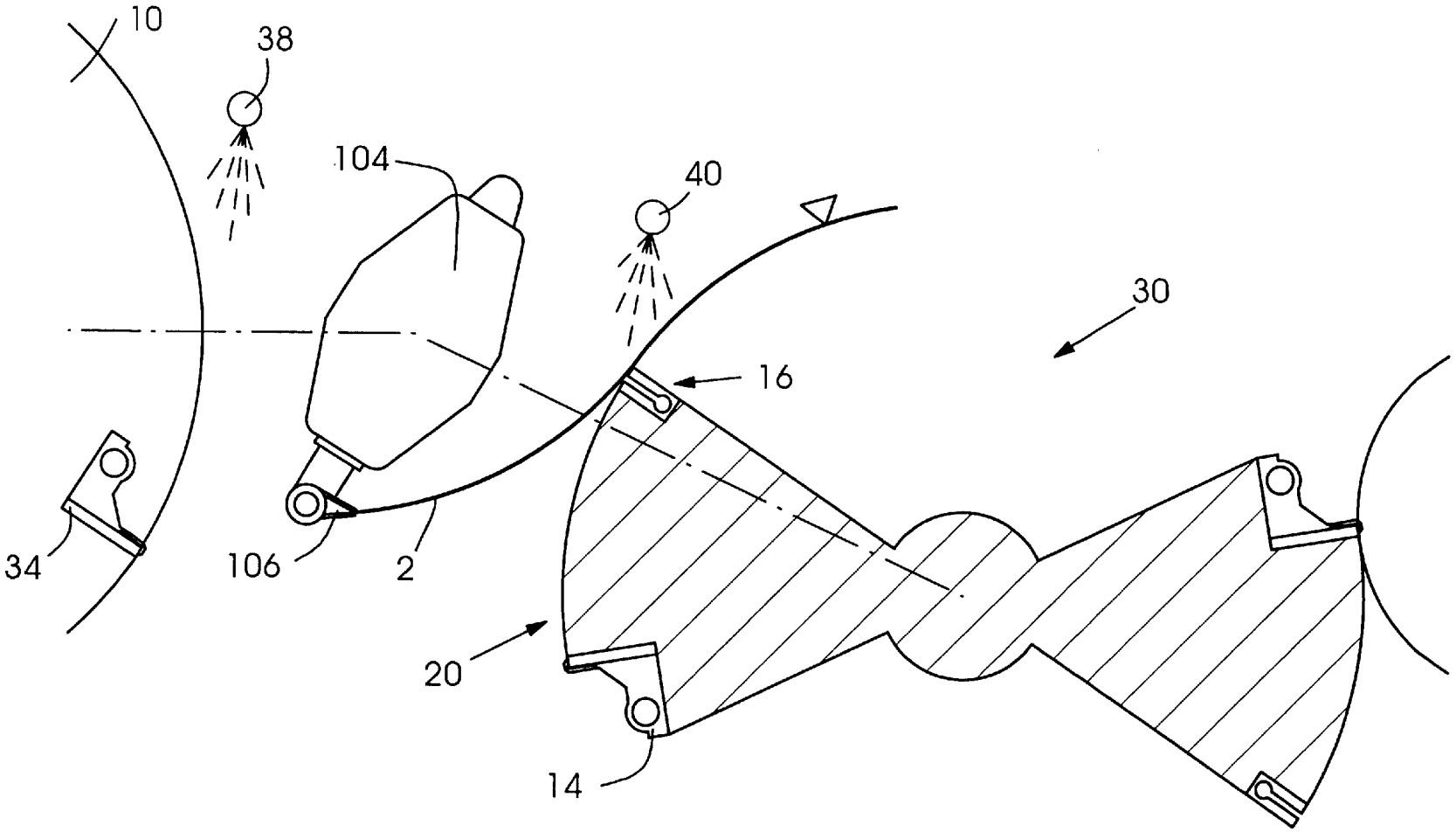
FIG. 5 is a view like that of FIG. 4 showing that embodiment of the apparatus in another operating phase thereof wherein the turning drum has rotated farther through an angle of about 90°, and the tongs-type gripper device disposed on the turning drum has been pivoted towards the center of the drum.
Figure 6:
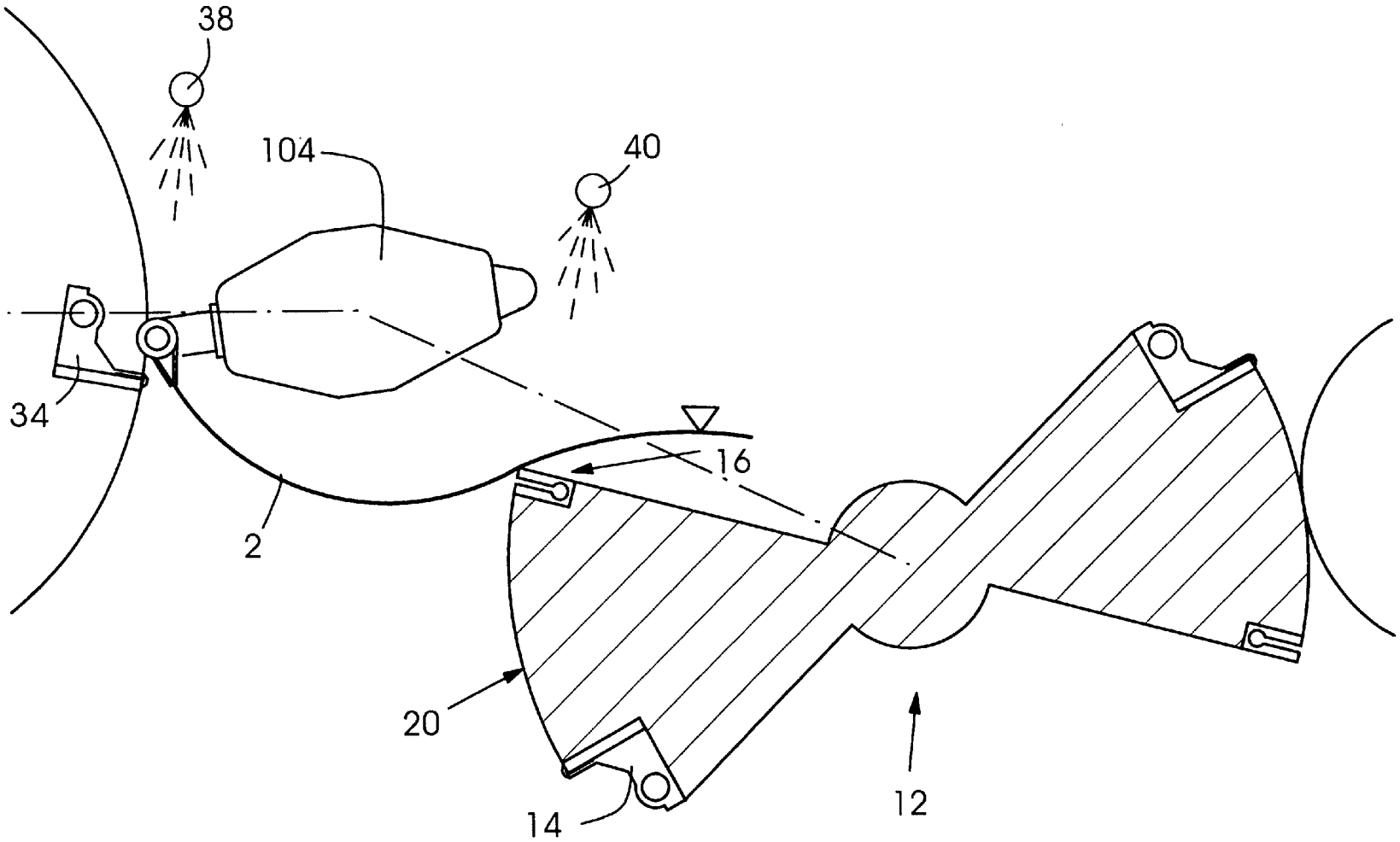
FIG. 6 is a view like those of FIGS. 4 and 5 showing the embodiment of the apparatus thereof in a further operating phase thereof wherein the gripper device of the turning drum is located just before the central transfer location between the turning drum and the succeeding or down-line cylinder, and the end of the sheet dips into a recess formed in the preceding or up-line storage drum.

In a further embodiment of the invention shown in FIGS. 4 to 6, the sheet-guiding cylinder 104 has a substantially polygonal cross section which, by way of example, may have the form of a compressed octagon flattened at the sides thereof. The gripper device 106 of the sheet-guiding cylinder 4 is, in this regard, pivotable overall by a pivoting device of the type used, for example, for the tongs-type grippers of turning drums in the prior art for perfector or recto-verso printing, but otherwise not shown in detail in the figures of the drawings. As shown in the various phases of rotation of the sheet-guiding cylinder 104 in FIGS. 4 to 6, the gripper device 106, after taking over the sheet 2 from the gripper device 14 of the preceding or up-line sheet-guiding cylinder 12, is pivoted overall in such a manner that the printed upper side 24 of the sheet 2 does not come into contact with the circumferential surface 126 of the sheet-guiding cylinder 104, thereby smearing the fresh print. The pivoting of the gripper device 106 is preferably performed in a manner that the radius of curvature possessed by the sheet 2 as a consequence of the curvature imparted thereto as it is being transported around the sheet-guiding cylinder 104, assumes the greatest possible value. Furthermore, depending upon the speed of the production run and upon the type of material to be printed and processed, the gripper device 106 may be pivoted, which permits a further increase in the spaced distance between the printed upper side 24 of the sheet 2 and the circumferential surface 126 of the sheet-guiding cylinder 104. Accordingly, the precaution or protection against smearing can be reliably avoided even under extreme operating conditions, such as very high production run speeds in the first-form or recto sheet printing mode. Moreover, in this embodiment of the invention, additional blower devices 138 and/or 140 may again be provided, which subject the regions between the sheet-guiding cylinder 104 and the preceding or up-line sheet-guiding cylinder 12, and between the sheet-guiding cylinder 104 and the succeeding or down-line sheet-guiding cylinder 10, respectively, to blown or blast air in the manner described hereinbefore.

In this embodiment of the invention, the sheet 2 is fixed to the circumferential surface 20 of the preceding or up-line sheet-guiding cylinder 12 in the same manner as is described for the embodiment of FIGS. 1 to 3, that is, depending upon the material being printed in the rear or trailing region of the sheet 2 for lightweight papers and, for heavier, stiff papers or cardboard, in the region between the front or leading edge of the sheet 2 and the middle of the sheet 2. However, in the case wherein stiff materials are to be printed on, in this embodiment of the invention, such fixation may be dispensed with entirely, so that the sheet 2 is guided without smearing solely by the pivoting of the gripper device 106 in the manner described hereinbefore.

Finally, in this embodiment of the invention, as well, the sheet-guiding cylinder 104 is preferably formed by the turning drum, and the preceding or up-line sheet-guiding cylinder 12 is preferably formed by the storage drum of a turning device of a sheet-fed rotary offset printing press which is being operated in the first-form or recto sheet printing mode. The storage drum here is preferably again adjusted to a predetermined sheet size which, by way of example, may be the smallest sheet size to be printed.

I claim:

1. A method for smear-free guidance of a printed sheet on a given sheet-guiding cylinder of a printing press, which comprises:

grasping a leading edge of a sheet from a preceding or up-line sheet-guiding cylinder with a gripper device of a given sheet-guiding cylinder;

after the grasping of the leading edge of the sheet with the gripper device, attaching a first section of an underside of the sheet to a circumferential surface of the preceding or up-line sheet-guiding cylinder;

pushing the sheet onwardly with the preceding or up-line cylinder to keep the sheet spaced from a circumferential surface of the given sheet-guiding cylinder; and rotating the given sheet-guiding cylinder within a circular path defined by movement of the gripper device.

2. The method according to claim 1, wherein, depending upon the material of the sheet to be printed on, the first section being attached to the circumferential surface of the first sheet-guiding cylinder, is disposed in a rear or trailing region of the sheet in the case of lightweight papers, and in a region located between the leading edge of the sheet and the middle of the sheet in the case of heavyweight papers.

3. The method according to claim 2, which includes causing a second section of the sheet extending from the first section to the end of the sheet to dip into a recess formed in the first sheet-guiding cylinder, after the first section of the sheet has moved past a central gripper station between the sheet-guiding cylinder and the preceding sheet-guiding cylinder.

4. The method according to claim 1, which includes unattaching the sheet before the first section of the sheet at which the sheet is attached to the circumferential surface of the preceding sheet-guiding cylinder has moved past a central gripper station between the given sheet-guiding cylinder and the cylinder preceding it.

5. The method according to claim 1, which includes applying suction to the first section of the underside of the sheet so as to suck the sheet against the circumferential surface of the preceding sheet-guiding cylinder and thereby attach the first section of the underside of the sheet to the circumferential surface.

6. The method according to claim 1, wherein the given sheet-guiding cylinder has a cross-sectional form deviating from a circular form, and which includes pivoting the gripper device of the given sheet-guiding cylinder, during the rotation of the given sheet-guiding cylinder, so that a radius of curvature of the sheet while it is being transported around the given sheet-guiding cylinder is increased.

7. The method according to claim 1, wherein the given sheet-guiding cylinder is formed as a turning drum, and the preceding sheet-guiding cylinder is formed as a storage drum of a turning device of a sheet-fed rotary offset printing press operating in a recto sheet printing mode, and which comprises adjusting the storage drum to a predetermined sheet size, depending upon the material of the sheet to be printed on.

8. The method according to claim 1, which comprises blowing air into the region between the given sheet-guiding cylinder and the preceding sheet-guiding cylinder and onto the sheet.

9. An apparatus for smear-free guidance of a printed sheet on a sheet-guiding cylinder of a printing press, comprising:

a gripper device moveable in a circular arc for guiding a leading edge of a sheet;

a first sheet-guiding cylinder having a circumferential surface and rotatable within the circular arc of said gripper device; and a second sheet-guiding cylinder having a circumferential surface and disposed downstream of said first sheet-guiding cylinder with respect to a sheet transport direction, said second sheet-guiding cylinder including a device for attaching a section of an underside of the sheet to said surface of said second sheet-guiding cylinder and for spacing the sheet away from said surface of said first sheet-guiding cylinder when said gripper device is guiding the leading edge of the sheet.

10. A method of handling paper sheets in a printing press machine, the method which comprises:

selecting a heavyweight paper for the sheet;

defining a region between the leading edge of the sheet and a middle of the sheet as the section of the underside of the sheet; and attaching the section of the underside of the sheet to the apparatus according to claim 9 at said surface of said second sheet-guiding cylinder.

11. The apparatus according to claim 9, wherein said second sheet-guiding cylinder is formed with a recess for receipt of another section of the sheet.

12. The apparatus according to claim 9, including:

a central gripper station located between the first sheet-guiding cylinder and the second sheet-guiding cylinder; said device for attaching the sheet being an actuatable device for releasing the sheet before the section of the sheet has moved past the central gripper station.

13. The apparatus according to claim 9, wherein said device for attaching the sheet is formed as a suction device.

14. The apparatus according to claim 13, wherein said suction device is a trailing-edge suction device of a storage drum of a turning device.

15. The apparatus according to claim 9, wherein said first sheet-guiding cylinder has a cross-sectional shape deviating from a circular shape, and includes a device for pivoting said gripper device of said first sheet-guiding cylinder, during rotation of said first cylinder, in a manner such that a radius of curvature imparted to the sheet during transport about said first sheet-guiding cylinder is increased.

16. The apparatus according to claim 15, wherein said first sheet-guiding cylinder has a cross-sectional shape of a compressed octagon flattened at the sides.

17. The apparatus according to claim 9, wherein said first sheet-guiding cylinder is a turning drum, and said second sheet-guiding cylinder is a storage drum of a turning device of a sheet-fed rotary offset printing press operating in a recto sheet printing mode, said storage drum being adjusted to a predetermined sheet size, depending upon the material of the sheet to be printed on.

18. The apparatus according to claim 9, including a first blower device for subjecting the region between said first sheet-guiding cylinder and said second sheet-guiding cylinder to blast air directed towards a printed upper side of the sheet.

19. The apparatus according to claim 18, including:

a third sheet-guiding cylinder disposed upstream of said first sheet-guiding cylinder with respect to the sheet transport direction; and a second blower device for subjecting the region between said first sheet-guiding cylinder and a said third sheet-guiding cylinder to blast air directed counter to the sheet transport direction.

20. The apparatus according to claim 9, wherein the given sheet-guiding cylinder is a turning drum of a sheet-fed rotary offset printing press in a recto sheet printing mode.

21. A method for smear-free guidance of a printed sheet on a sheet-guiding cylinder of a printing press, which comprises:

using a gripper device cooperating with a given sheet-guiding cylinder to take a leading edge of a sheet transferred from a preceding sheet-guiding cylinder;

rotating the given sheet-guiding cylinder within a circular path defined by movement of the gripper device;

pivoting the gripper device of the given sheet-guiding cylinder, during the rotation of the given cylinder, in such a manner that a radius of curvature assumed by the sheet during transport about the given sheet-guiding cylinder is increased; and guiding the printed side of the sheet at a spaced distance from the circumferential surface of the given sheet-guiding cylinder.

22. The method according to claim 21, wherein the given sheet-guiding cylinder is formed as a turning drum, and the preceding sheet-guiding cylinder is formed as a storage drum of a turning device of a sheet-fed rotary offset printing press operating in a recto sheet printing mode, and includes adjusting the storage drum to a predetermined sheet size, depending upon the material to be printed on.

23. The method according to claim 21, which includes blowing air into the region between the given sheet-guiding cylinder and the preceding sheet-guiding cylinder and onto the printed side of the sheet, and/or the region between the given sheet-guiding cylinder and a succeeding sheet-guiding cylinder, counter to the sheet transport direction,for assisting in the guidance of the sheet.

* * * * *

UNITED STATES PATENT AND TRADEMARK OFFICE

CERTIFICATE OF CORRECTION

PATENT NO. : 5,979,318
DATED : November 9, 1999
INVENTOR(S) : Karl-Heinz Helmstädter It is certified that error appears in the above-identified patent and that said Letters Patent is hereby corrected as shown below:

Title page,
Below the abstract "23 Claims, 4 Drawing Sheets" should read -- 23 Claims 6, 6 Drawing Sheets --.
Below the abstract should be replaced with the figure below.

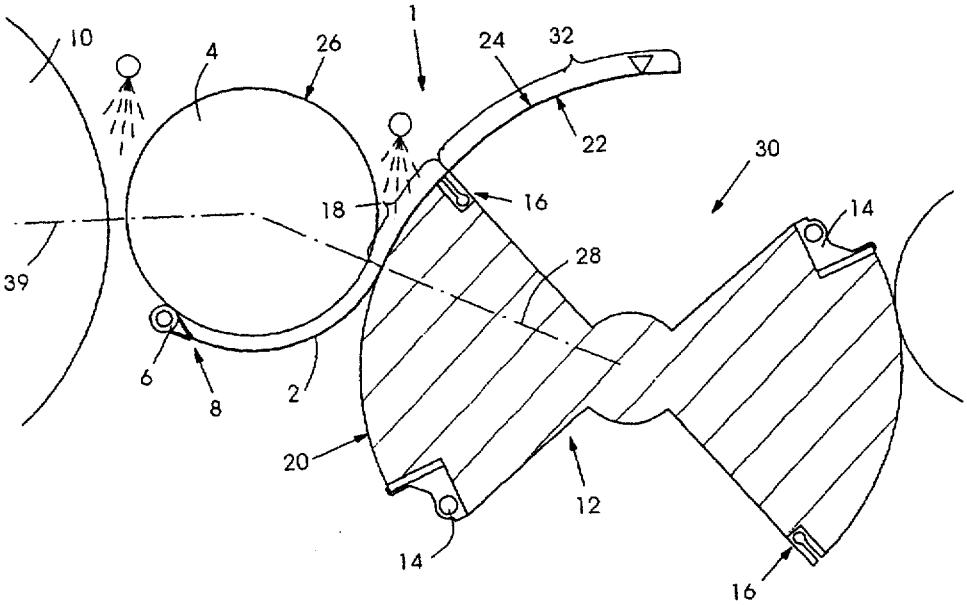

UNITED STATES PATENT AND TRADEMARK OFFICE

CERTIFICATE OF CORRECTION

PATENT NO. : 5,979,318
DATED : November 9, 1999
INVENTOR(S) : Karl-Heinz Helmstädter It is certified that error appears in the above-identified patent and that said Letters Patent is hereby corrected as shown below:

On the first drawing sheet,
Line 1, "Sheet 1 of 4" should read -- Sheet 1 of 6 --; and the figure on the first drawing sheet should be replaced by the figure below.

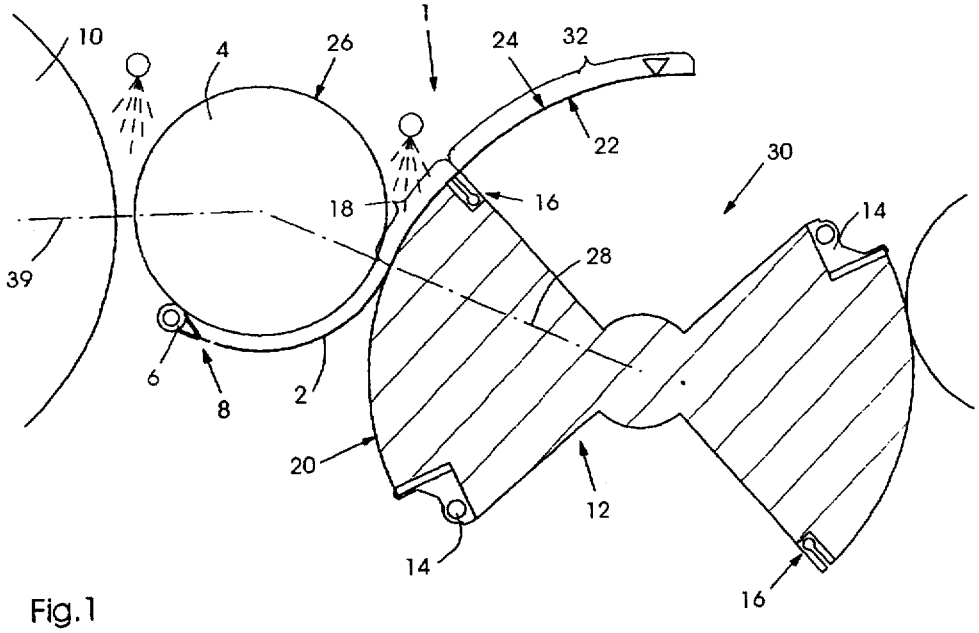

Fig.1

UNITED STATES PATENT AND TRADEMARK OFFICE

CERTIFICATE OF CORRECTION

PATENT NO. : 5,979,318
DATED : November 9, 1999
INVENTOR(S) : Karl-Heinz Helmstädter It is certified that error appears in the above-identified patent and that said Letters Patent is hereby corrected as shown below:

On the second drawing sheet,
Line 1, "Sheet 2 of 4" should read -- Sheet 2 of 6 --; and the figures on the second drawing sheet should be replaced by the figure below.

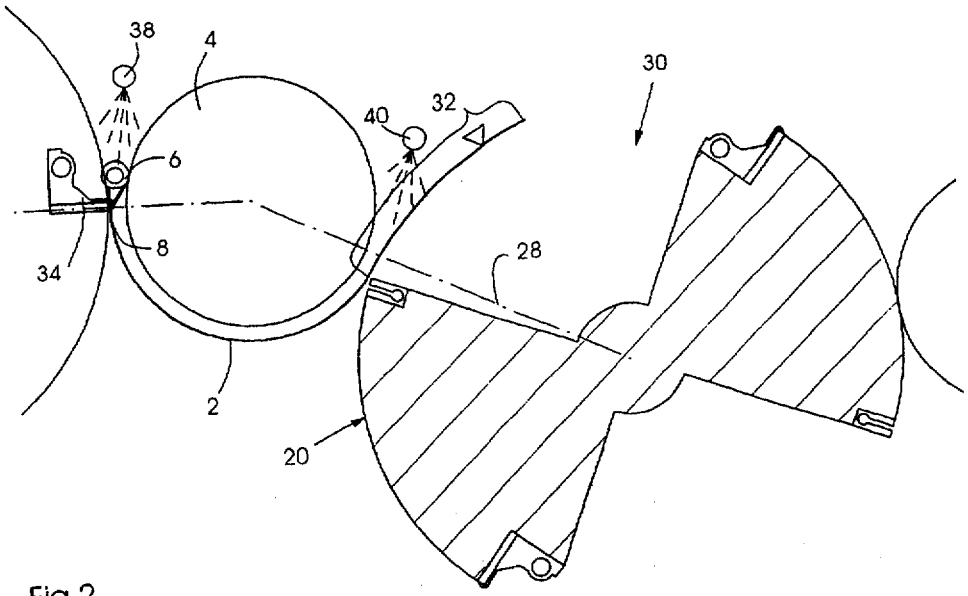

Fig.2

UNITED STATES PATENT AND TRADEMARK OFFICE

CERTIFICATE OF CORRECTION

PATENT NO. : 5,979,318
DATED : November 9, 1999
INVENTOR(S) : Karl-Heinz Helmstädter It is certified that error appears in the above-identified patent and that said Letters Patent is hereby corrected as shown below:

On the third drawing sheet,
Line 1, "Sheet 3 of 4" should read -- Sheet 3 of 6 --; and the figure on the third drawing sheet should be replaced by the figure below.

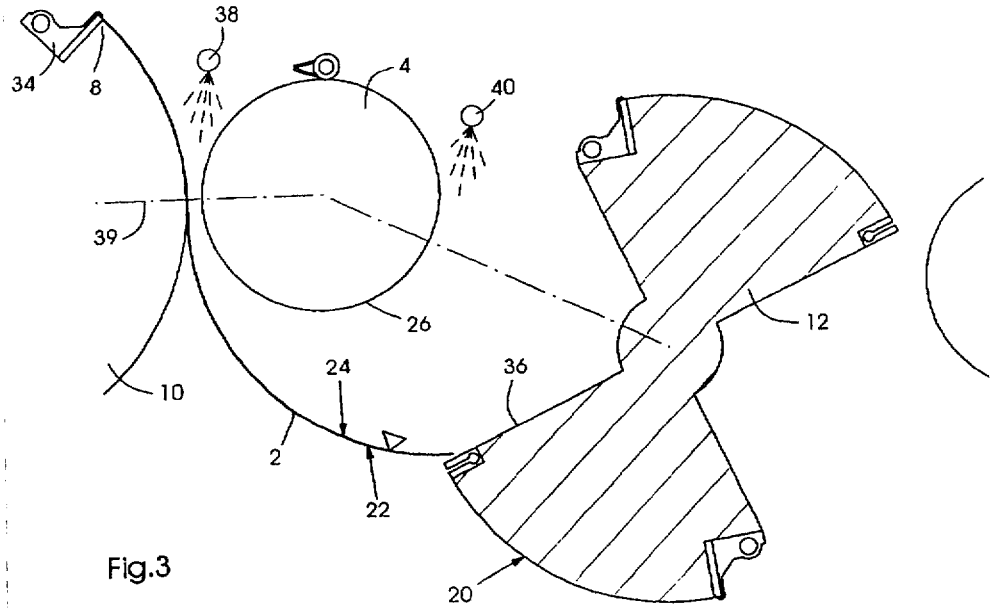

Fig.3

UNITED STATES PATENT AND TRADEMARK OFFICE

CERTIFICATE OF CORRECTION

PATENT NO. : 5,979,318
DATED : November 9, 1999
INVENTOR(S) : Karl-Heinz Helmstädter It is certified that error appears in the above-identified patent and that said Letters Patent is hereby corrected as shown below:

On the fourth drawing sheet,
Line 1, "Sheet 4 of 4 should read -- Sheet 4 of 6 --; and the figure on the fourth drawing sheet should be replaced by the figure below.

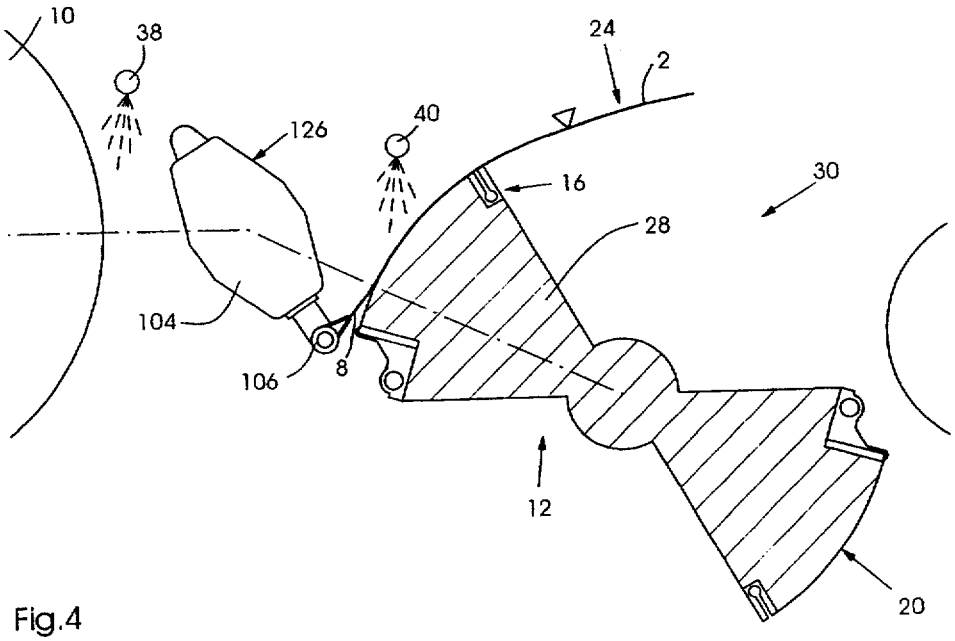

Fig.4

UNITED STATES PATENT AND TRADEMARK OFFICE

CERTIFICATE OF CORRECTION

PATENT NO. : 5,979,318
DATED : November 9, 1999
INVENTOR(S) : Karl-Heinz Helmstädter It is certified that error appears in the above-identified patent and that said Letters Patent is hereby corrected as shown below:

A fifth drawing sheet should be addad which reads on its first line
-- U.S. Patent Nov. 9, 1999 Sheet 5 of 6 5,979,318 --,
and which shows the figure below.

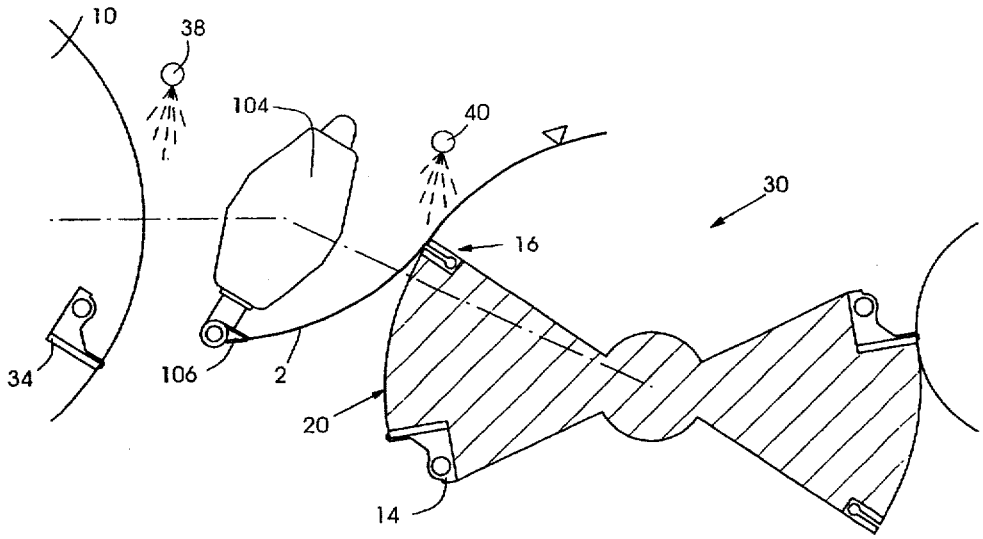

Fig.5

UNITED STATES PATENT AND TRADEMARK OFFICE

CERTIFICATE OF CORRECTION

PATENT NO. : 5,979,318
DATED : November 9, 1999
INVENTOR(S) : Karl-Heinz Helmstädter It is certified that error appears in the above-identified patent and that said Letters Patent is hereby corrected as shown below:

A sixth drawing sheet should be added which reads on its first line
-- U.S. Patent Nov. 9, 1999 Sheet 6 of 6 5,979,318 --,
and which shows the figure below.

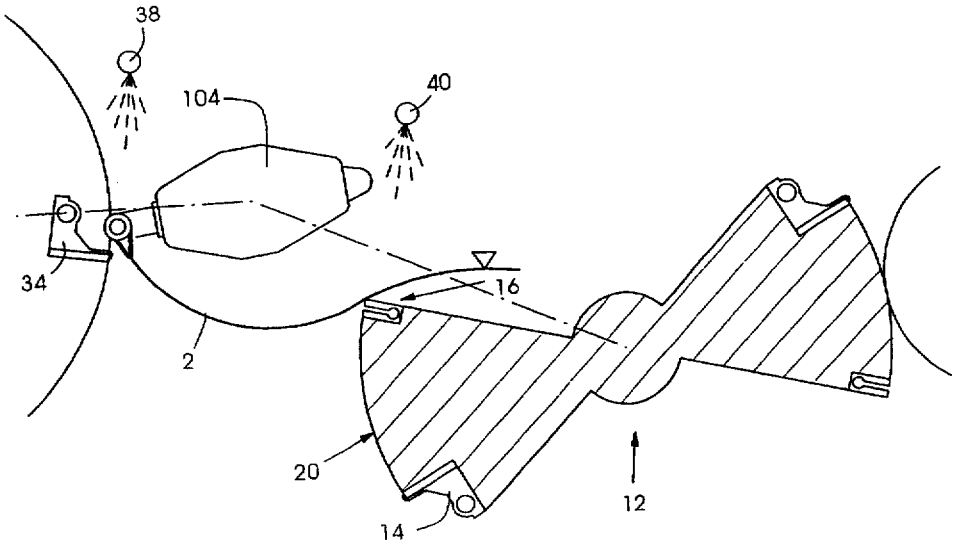

Fig.6

Signed and Sealed this

Eighteenth Day of September, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 5,979,318
DATED : November 9, 1999
INVENTOR(S) : Karl-Heinz Helmstädter It is certified that error appears in the above-identified patent and that said Letters Patent is hereby corrected as shown below:

Title page,
The title page showing the illustrative figure should be deleted to be replaced with the attached title page.

Drawings,
Drawing sheets, consisting of Figs. 1-6, should be deleted to be replaced with the drawing Sheets, consisting of Figs. 1-6 as shown on the attached page.

United States Patent [19]

Helmstädter

[11] Patent Number: 5,979,318

[45] Date of Patent: Nov. 9, 1999

[54] METHOD AND APPARATUS FOR SMEAR-FREE GUIDANCE OF A PRINTED SHEET ON A SHEET-GUIDING CYLINDER OF A PRINTING PRESS

[75] Inventor: Karl-Heinz Helmstädter, Sinsheim, Germany

[73] Assignee: Heidelberger Druckmaschinen AG, Heidelberg, Germany

[21] Appl. No.: 09/050,658

[22] Filed: Mar. 30, 1998

[30] Foreign Application Priority Data

Mar. 29, 1997 [DE] Germany ..... 197 13 361

[51] Int. Cl.[6] ..... B41F 13/24

[52] U.S. Cl. ..... 101/232; 101/419; 101/420; 271/268; 271/277

[58] Field of Search ..... 101/416.1, 419, 101/420, 229, 230, 232, 240; 271/82, 85, 204, 205, 268, 277, 195, 269

[56] References Cited

U.S. PATENT DOCUMENTS

| | | | |
|---|---|---|---|
| 4,395,949 | 8/1983 | Jeschke | 101/420 |
| 4,815,379 | 3/1989 | Becker et al. | 101/246 |
| 5,029,524 | 7/1991 | Wirz et al. | 101/232 |
| 5,421,257 | 6/1995 | Okuda et al. | 101/137 |
| 5,787,810 | 8/1998 | Stephan | 101/232 |

*Primary Examiner*—Edgar Burr
*Assistant Examiner*—Dave A. Ghatt
*Attorney, Agent, or Firm*—Herbert L. Lerner; Laurence A. Greenberg

[57] ABSTRACT

A method for smear-free guidance of a printed sheet on a given sheet-guiding cylinder of a printing press includes taking over a leading edge of the sheet by a gripper device of the given sheet-guiding cylinder from a preceding or up-line sheet-guiding cylinder and, after the take-over of the leading edge of the sheet by the gripper device, fixing a first section of the underside of the sheet to the circumferential surface of the preceding or up-line sheet-guiding cylinder in a manner that the sheet, which has been pushed onwardly by the preceding or up-line sheet-guiding cylinder, is kept spaced from the circumferential surface of the given sheet-guiding cylinder, and the circumferential surface of the given sheet-guiding cylinder is located, as viewed in radial direction, within a circular path described by the gripper device during the rotation of the given cylinder.

23 Claims, 6 Drawing Sheets

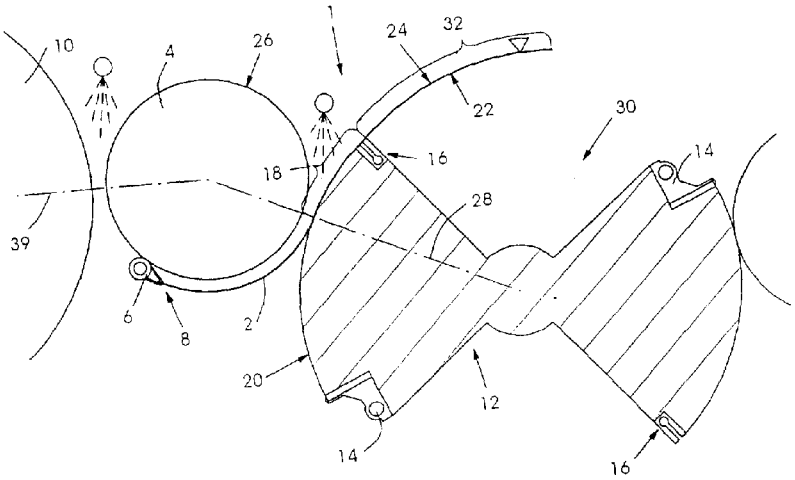

UNITED STATES PATENT AND TRADEMARK OFFICE

CERTIFICATE OF CORRECTION

PATENT NO. : 5,979,318
DATED : November 9, 1999
INVENTOR(S) : Karl-Heinz Helmstädter It is certified that error appears in the above-identified patent and that said Letters Patent is hereby corrected as shown below:

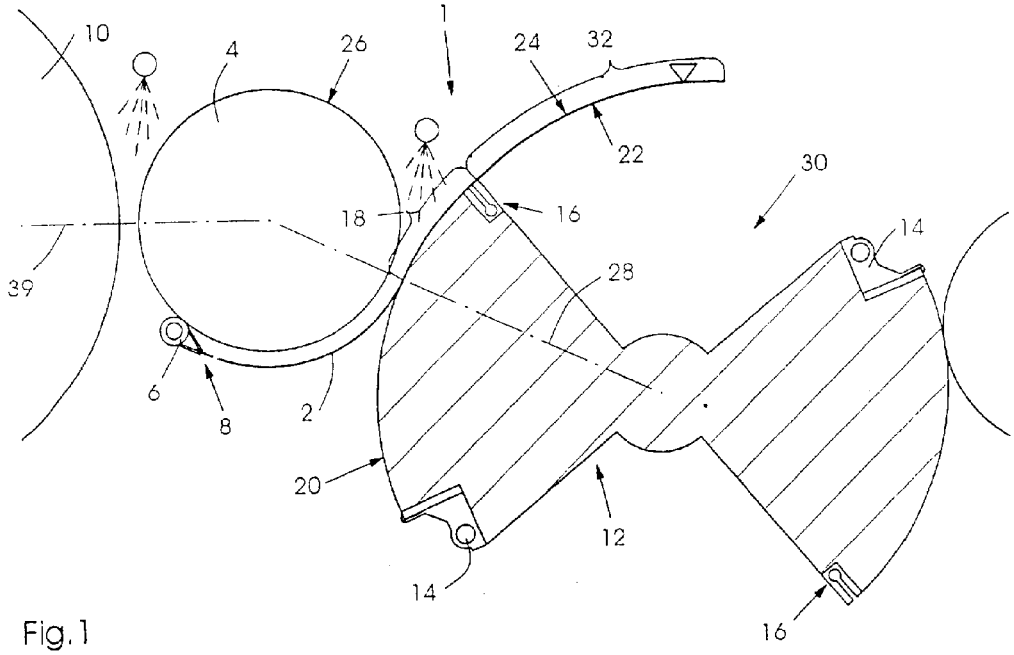

Fig. 1

UNITED STATES PATENT AND TRADEMARK OFFICE

CERTIFICATE OF CORRECTION

PATENT NO. : 5,979,318
DATED : November 9, 1999
INVENTOR(S) : Karl-Heinz Helmstädter It is certified that error appears in the above-identified patent and that said Letters Patent is hereby corrected as shown below:

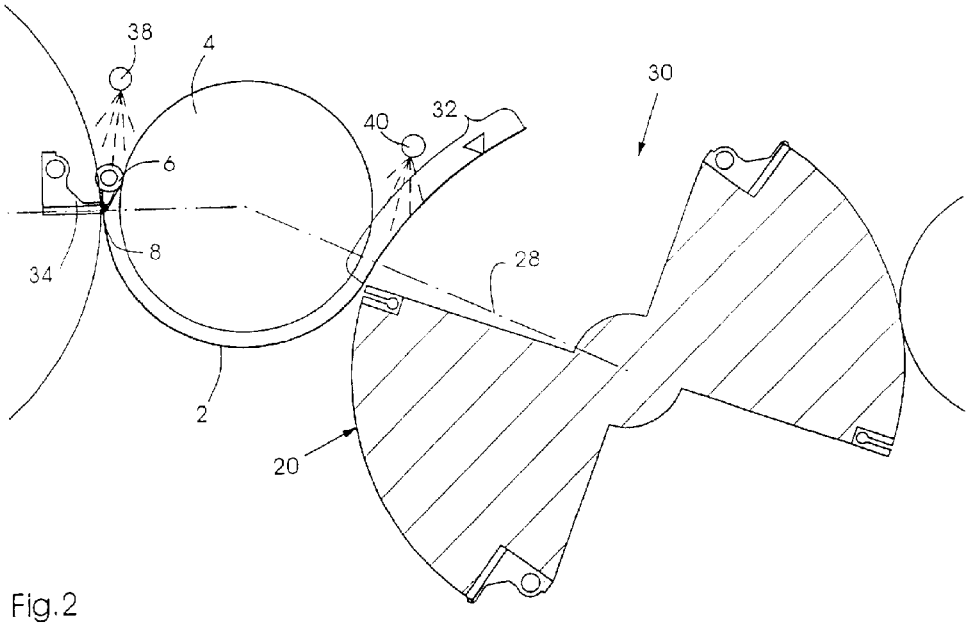

Fig. 2

UNITED STATES PATENT AND TRADEMARK OFFICE

CERTIFICATE OF CORRECTION

PATENT NO. : 5,979,318
DATED : November 9, 1999
INVENTOR(S) : Karl-Heinz Helmstädter It is certified that error appears in the above-identified patent and that said Letters Patent is hereby corrected as shown below:

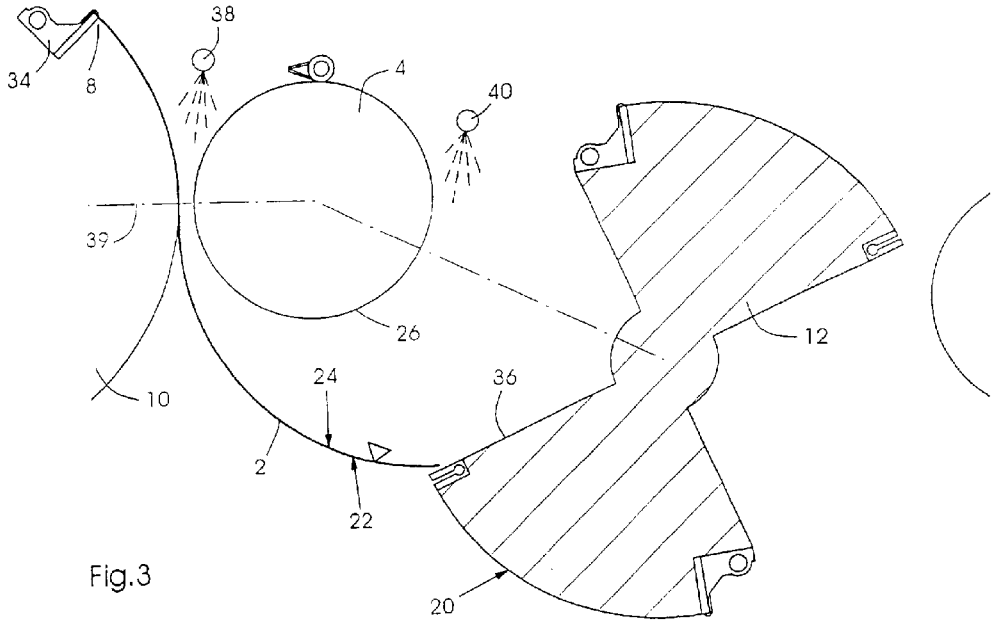

Fig.3

UNITED STATES PATENT AND TRADEMARK OFFICE

CERTIFICATE OF CORRECTION

PATENT NO. : 5,979,318
DATED : November 9, 1999
INVENTOR(S) : Karl-Heinz Helmstädter It is certified that error appears in the above-identified patent and that said Letters Patent is hereby corrected as shown below:

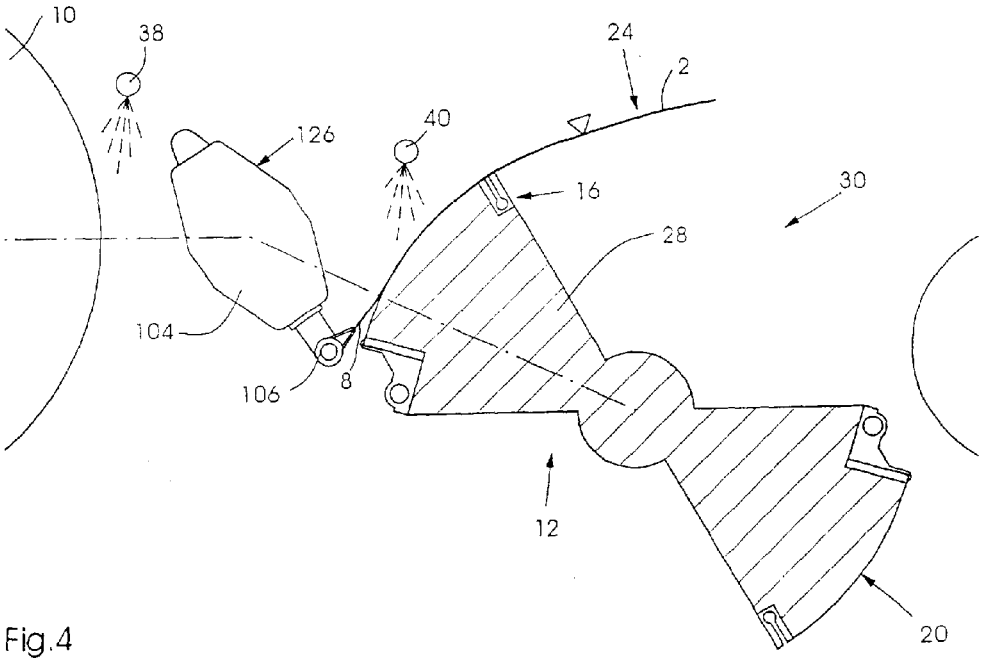

Fig.4

UNITED STATES PATENT AND TRADEMARK OFFICE

CERTIFICATE OF CORRECTION

PATENT NO. : 5,979,318
DATED : November 9, 1999
INVENTOR(S) : Karl-Heinz Helmstädter It is certified that error appears in the above-identified patent and that said Letters Patent is hereby corrected as shown below:

A fifth drawing sheet should be added which reads on its first line
-- U.S. Patent Nov. 9, 1999 Sheet 5 of 6 5,979,318 --,
and which shows the figure below.

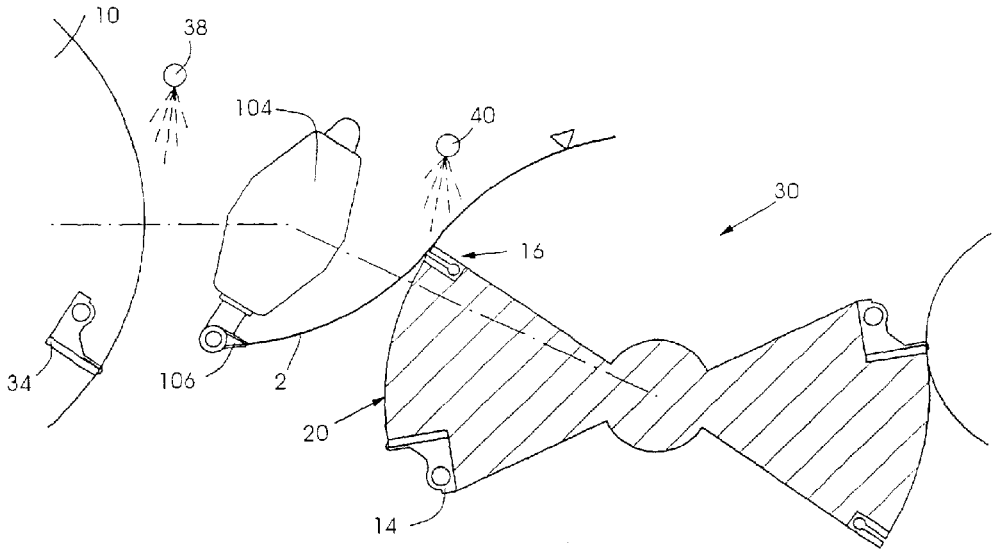

Fig.5

UNITED STATES PATENT AND TRADEMARK OFFICE

CERTIFICATE OF CORRECTION

PATENT NO. : 5,979,318
DATED : November 9, 1999
INVENTOR(S) : Karl-Heinz Helmstädter It is certified that error appears in the above-identified patent and that said Letters Patent is hereby corrected as shown below:

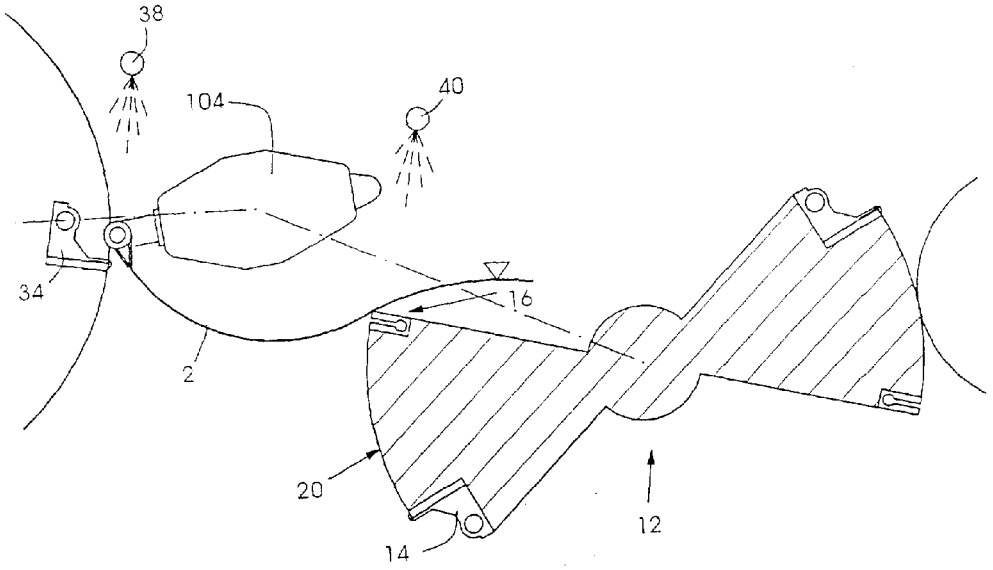

Fig.6

Signed and Sealed this

First Day of October, 2002

*Attest:*

*Attesting Officer*

JAMES E. ROGAN
*Director of the United States Patent and Trademark Office*